US005136294A

United States Patent [19]

Iwata

[11] Patent Number: 5,136,294

[45] Date of Patent: Aug. 4, 1992

[54] MULTIBEAM ANTENNA

[75] Inventor: Ryuichi Iwata, Tokyo, Japan

[73] Assignee: NEC Corporation, Tokyo, Japan

[21] Appl. No.: 663,767

[22] Filed: Mar. 1, 1991

Related U.S. Application Data

[63] Continuation of Ser. No. 143,099, Jan. 12, 1988, abandoned.

[30] Foreign Application Priority Data

Jan. 12, 1987 [JP] Japan ..... 62-4535
Jan. 19, 1987 [JP] Japan ..... 62-9753

[51] Int. Cl.[5] ..... H01Q 13/00

[52] U.S. Cl. ..... 343/781 P; 343/781 CA; 343/914

[58] Field of Search ..... 343/781 P, 781 GA, 840, 343/761, DIG. 2, 914, 776, 779

[56] References Cited

U.S. PATENT DOCUMENTS

| | | | |
|---|---|---|---|
| 3,096,519 | 7/1963 | Martin | 343/756 |
| 3,852,763 | 12/1974 | Kruetel, Jr. et al. | 343/DIG. 2 |
| 3,898,667 | 8/1975 | Raab | 343/756 |
| 4,208,661 | 6/1980 | Vokurka | 343/781 P |
| 4,544,928 | 10/1985 | Afifi et al. | 343/914 |
| 4,605,935 | 8/1986 | Kusano | 343/914 |
| 4,647,938 | 3/1987 | Roederer et al. | 343/761 |
| 4,712,111 | 12/1987 | Ohta et al. | 343/914 |
| 4,792,813 | 12/1988 | Rosen | 343/781 P |
| 4,823,143 | 4/1989 | Bockrath | 343/781 P |

FOREIGN PATENT DOCUMENTS

| | | | |
|---|---|---|---|
| 58-84506 | 5/1983 | Japan | 343/781 R |
| 59-39104 | 3/1984 | Japan | 343/781 R |
| 59-229902 | 12/1984 | Japan | 343/781 R |
| 60-3210 | 1/1985 | Japan | 343/914 |
| 60-3211 | 1/1985 | Japan | 343/781 R |

*Primary Examiner*—Michael C. Wimer
*Assistant Examiner*—Hoanganh Le
*Attorney, Agent, or Firm*—Sughrue, Mion, Zinn Macpeak & Seas

[57] ABSTRACT

A multibeam antenna capable of communicating with a plurality of satellites on stationary orbits at the same time includes a single main reflector, and a plurality of primary radiators for radiating electromagnetic waves toward the main reflector. The main reflector is constituted by the same number of partial reflectors as the primary radiators, the partial reflectors being joined to each other. Each of the partial reflectors is defined by a part of a different one of paraboloids which are different in the position of focus from each other. The primary reflectors are located at the positions of individual focuses. A subreflector is disposed between the main reflector and the positions of focuses and made up of a plurality of curved portions and a single flat portion.

6 Claims, 7 Drawing Sheets

MULTIBEAM ANTENNA

BACKGROUND OF THE INVENTION

The present invention relates to a multibeam antenna capable of communicating with a plurality of satellites which are positioned on stationary orbits at the same time.

A prior art multibeam antenna is constituted by a plurality of primary radiators and a single parabolic reflector for reflecting an electromagnetic wave radiating from each primary radiator in a different direction. The primary radiators are located in the vicinity of the focus of the parabolic reflector, or paraboloid, at a suitable distance from each other. A feeder section and a low-noise amplifier are associated with each of the primary radiators in such a manner as to extend along the axis of the antenna.

In the above-described prior art antenna, the deviation of the beams radiating from the parabolic reflector cannot be increased without increasing the distance between the primary radiators. However, an increase in the distance between the nearby primary radiators necessarily results in the shift of the primary radiators away from the focus of the parabolic reflector, whereby the wavefront in the aperture plane of the parabolic reflector is disturbed to lower antenna gain. Another problem with the prior art antenna is that the feeder section and amplifier section directly connected to each of the primary reflectors increase the length of antenna axis because they are arranged along the antenna axis.

For details of such a prior art multibeam antenna, a reference may be made to U.S. Pat. No. 3,852,763 by way of example.

SUMMARY OF THE INVENTION

It is an object of the present invention to provide a multibeam antenna having improved antenna efficiency.

It is another object of the present invention to provide a multibeam antenna which eliminates the disturbance to the wavefront in an aperture plane to thereby allow the deviation of beams radiating to be increased.

It is another object of the present invention to provide a multibeam antenna which allows the length of an antenna axis reduced.

It is another object of the present invention to provide a multibeam antenna which suppresses the decrease in the phase performance in an aperture plane.

It is another object of the present invention to provide a multibeam antenna which allows the lateral dimension of a main reflector to be reduced.

It is another object of the present invention to provide a generally improved multibeam antenna.

A multibeam antenna of the present invention comprises a main reflector constituted by at least a first and a second partial reflector, the first partial reflector being defined by a part of a first paraboloid which has a first focus and a first axis of rotation, the second partial reflector being defined by a part of a second paraboloid which has a second focus and a second axis of rotation, the first and second partial reflectors being joined to each other with the first and second axes oriented in different directions from each other, a first primary radiator radiating an electromagnetic wave toward the main reflector to irradiate the first partial reflector and a part of the second reflector, and a second primary radiator for radiating an electromagnetic wave toward the main reflector to irradiate the second partial reflector and a part of the first partial reflector.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
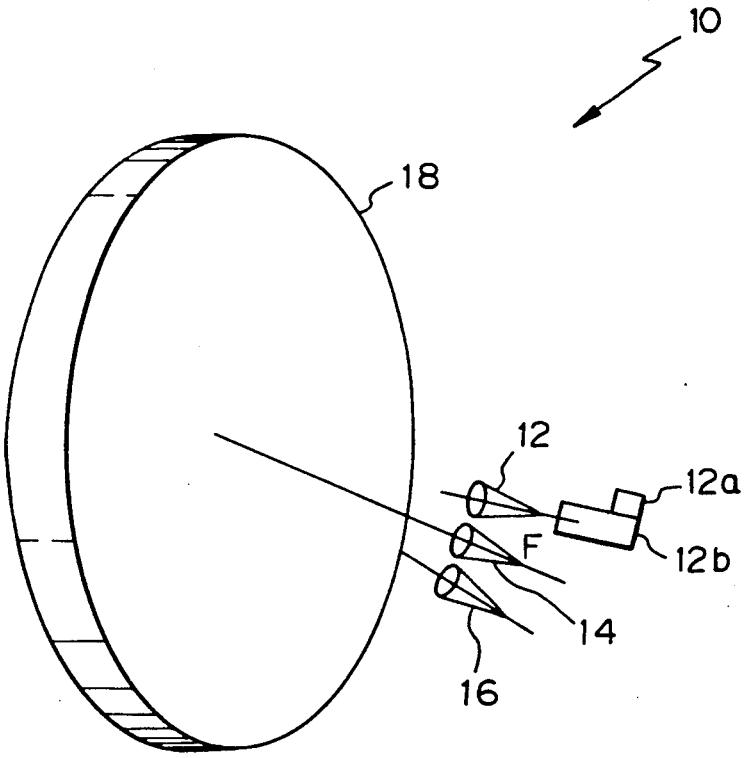
Fig. 1 PRIOR ART
FIG. 1 is a schematic view showing a prior art multibeam antenna.

To facilitate an understanding of the present invention, a brief reference will be made to a prior art multibeam antenna, shown in FIG. 1. As shown, an exemplary multibeam antenna 10 includes a plurality of, three for example, primary radiators 12, 14 and 16, and a single parabolic reflector 18 which reflects each of electromagnetic waves radiated from the primary radiators in a different direction. The primary radiators 12, 14 and 16 are located in the vicinity of the focus F of the parabolic refector 18 at a suitable distance from each other. A feeder section **12*a* and a low-noise amplifier 12*b* are associated with each of the primary radiators, as represented by the radiator 12** in the figure, and so arranged as to extend along the axis of the antenna.

As previously discussed, a problem with the prior art antenna 10 is that an increase in the distance between the primary radiators 12, 14 and 16 causes them to be shifted away from the focus F, disturbing the wavefront in the aperture plane of the parabolic reflector 18 and, thereby, lowering antenna gain. Further, the feeder section and low-noise amplifier directly connected to each of the primary radiators extend in the axial direction of the antenna, increasing the overall length of the antenna axis.

Figure 2A:
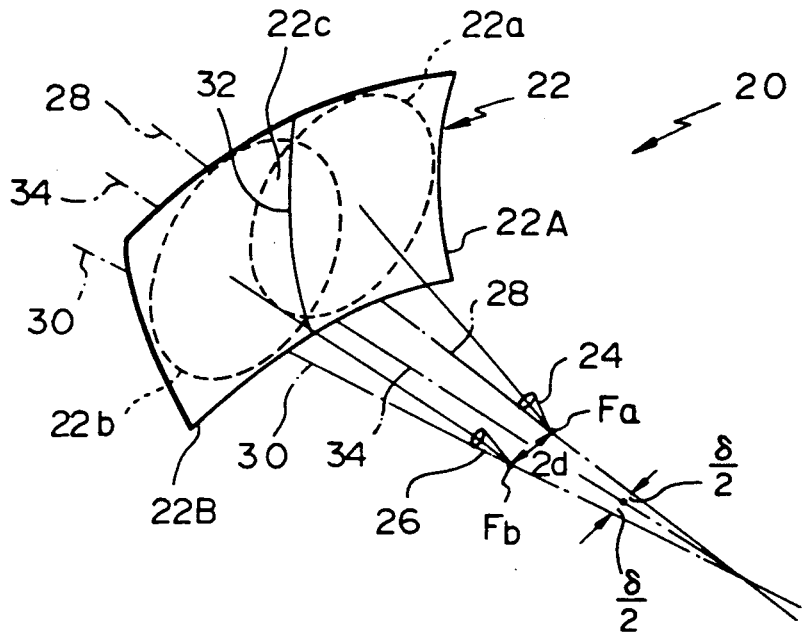
FIGS. 2A and 2B are views showing a first embodiment of the multibeam antenna in accordance with the present invention.
Figure 2B:
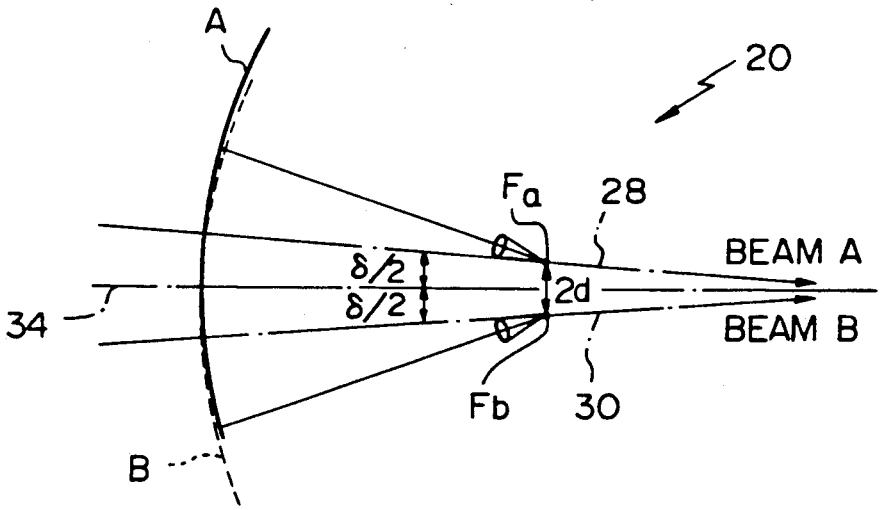

Referring to FIGS. 2A and 2B, a multibeam antenna embodying the present invention is shown and generally designated by the reference numeral 20. In this particular embodiment, the antenna 20 comprises two-beam antenna which is made up of a main reflector 22 and two main radiators 24 and 26. The main reflector 22 is constituted by two partial reflectors 22A and 22B which are defined by, respectively, a part of a paraboloid A and a part of a paraboloid B. The partial reflectors 22A and 22B are joined to each other along a boundary line 32 such that the axis of rotation 28 of the paraboloid A and the axis of rotation 30 of the paraboloid B intersect each other. Each of the axes of rotation 28 and 30 is inclined by an angle of $\delta/2$ relative to the center axis 34 of the antenna. The foci Fa and Fb of the paraboloids A and B, respectively, which are located on the individual axes are spaced apart by a distance of *2d* from each other.

The primary radiator 24 is positioned at the focus Fa on the axis 28 while the primary radiator 26 is positioned at the focus Fb on the axis 30. In this configuration, the primary radiator 26 mainly irradiates a region **22*b* of the partial reflector 22A, and the primary reflector 26 mainly irradiates a region 22*b* of the partial reflector 22B. As shown, the regions 22*a* and 22*b* overlap each other as at 22*c* along the boundary line 22. Specifically, the region 22*a* is constituted by the partial reflector 22A and a part of the partial reflector 22B while the region 22*b* is constituted by the partial reflector 22B and a part of the partial reflector 22A. The surface curve of the region 22*a* and that of the region 22*b*** can be approximately equalized to the paraboloids A and B, respectively, by adequately selecting the distance *2d* between the primary radiators 24 and 26.

In the above arrangement, rays radiating from the focus Fa are reflected by the region **22*a* of the main reflector 22 to become rays which are substantially parallel to the center axis 28 of the paraboloid A (radiation direction of beam A). Likewise, rays radiating from the focus Fb are reflected by the region 22*b* of the main reflector 22 to become rays which are substantially parallel to the center axis 30 of the paraboloid B (radiation direction of beam B). Specifically, electromagnetic waves coming out of the primary radiators 24 and 26 are radiated in different directions from each other, i.e., in the direction of the axis 28 and that of the axis 30**.

The construction described above constitutes a two-beam antenna.

Figure 3A:
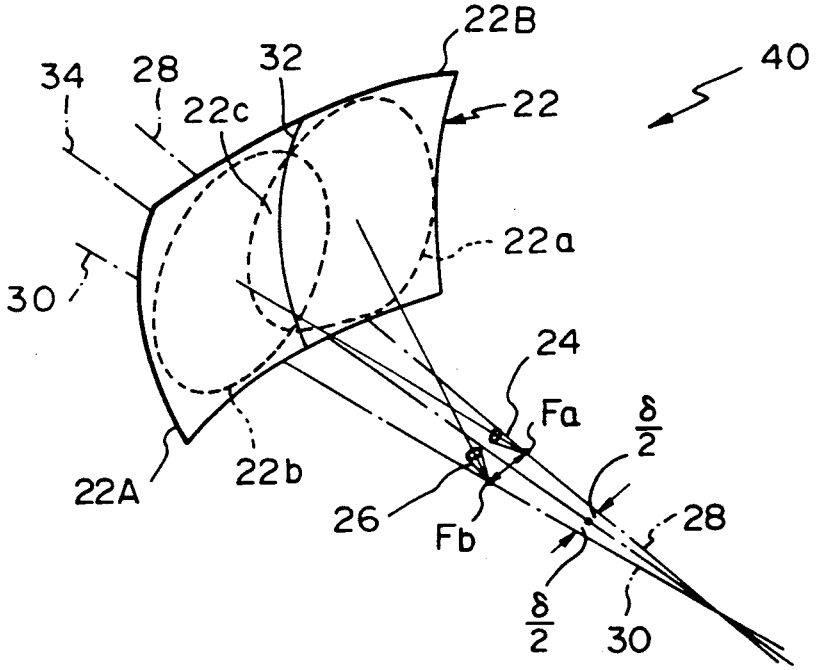
FIGS. 3A and 3B are views showing a second embodiment of the present invention.
Figure 3B:
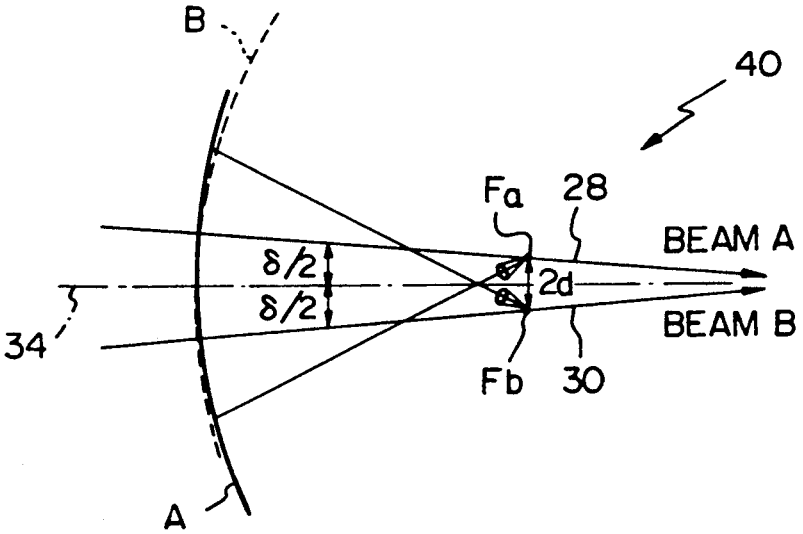

Referring to FIGS. 3A and 3B, a second embodiment of the multibeam antenna in accordance with the present invention is shown. While in the first embodiment the primary radiators 24 and 26 and their associated partial reflectors 22A and 22B are located on the same side with respect to the center axis 34 of the antenna 20, in the second embodiment the radiators 24 and 26 and their associated partial reflectors 22A and 22B are located at the opposite sides. Specifically, as shown in FIGS. 3A and 3B, the partial reflector 22A associated with the primary reflector 24 is constituted by a part of the paraboloid B while the partial reflector 22B associated with the primary radiator 26 is constituted by a part of the paraboloid A. The rest of the second embodiment is identical in construction as the first embodiment.

Figure 4A:
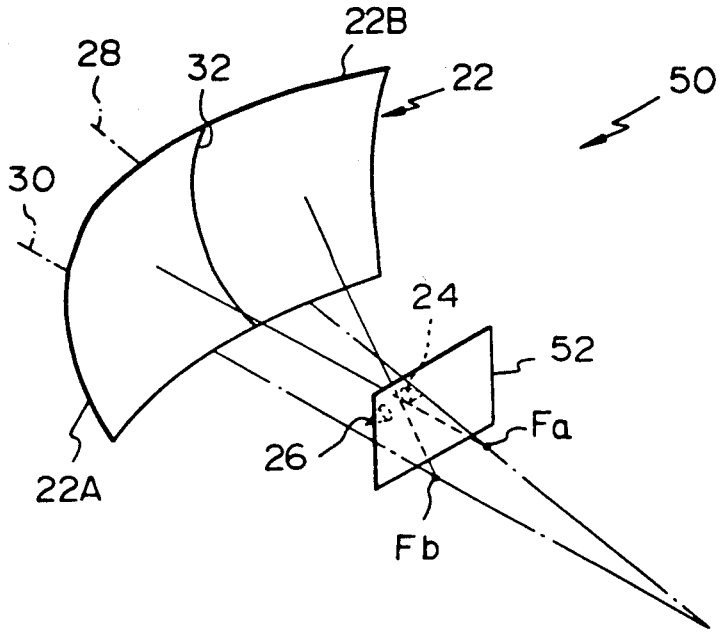
FIGS. 4A and 4B are views showing a third embodiment of the present invention.
Figure 4B:
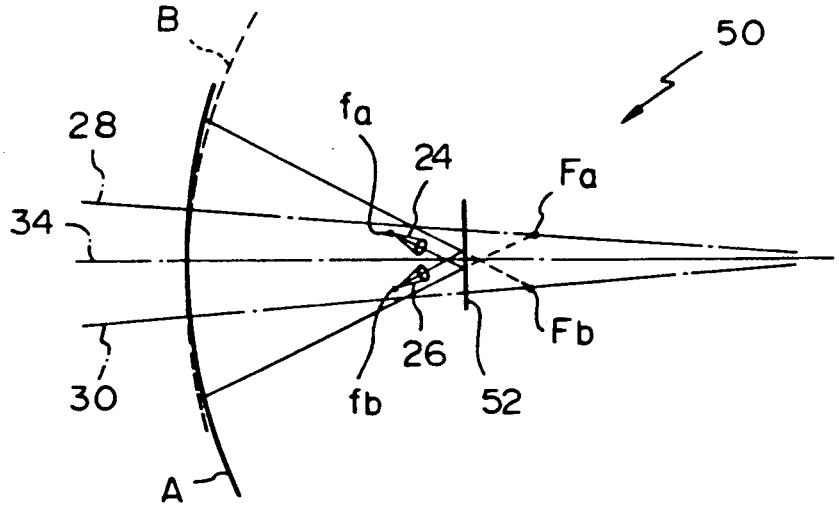

Referring to FIGS. 4A and 4B, a third embodiment of the multibeam antenna in accordance with the present invention is showm. As shown, the multibeam antenna 50 includes a flat reflector 52 which is located between the main reflector 22 and the two foci Fa and Fb. The primary radiators 24 and 26 are located at, respectively, the inverted image points fa and fb of the foci Fa and Fb as defined by the flat reflector 52, the radiators 24 and 26 each facing the flat reflector 52. In this construction, electromagnetic waves radiating from the primary radiators 24 and 26 are individually reflected by the flat reflector 52 and, then, by the main reflector 22 to be radiated in two different directions. The flat reflector 52 simply serves to bend the paths of electromagnetic waves and, therefore, the antenna 50 per se shares the same principle of operation as the antenna 20 of the first embodiment. An advantage attainable with the flat reflector 52 is the reduction of the axial length of the antenna.

Figure 5A:
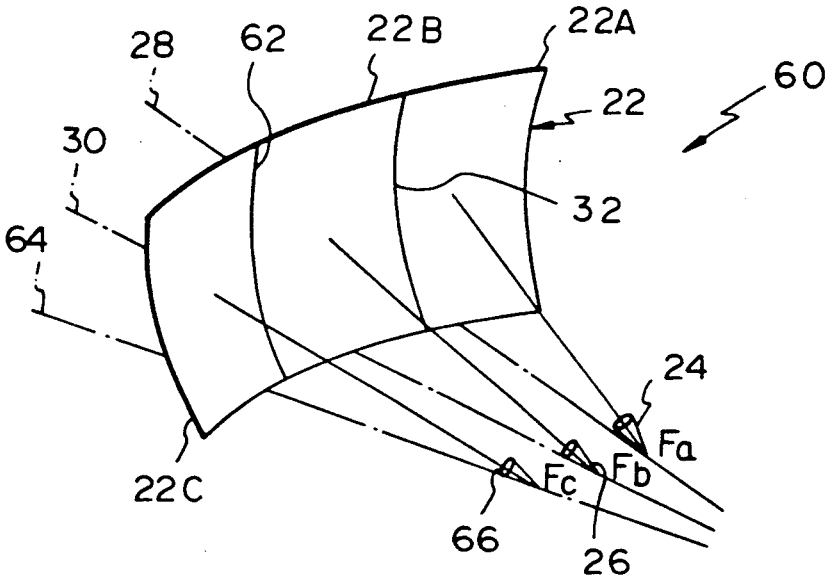
FIGS. 5A and 5B are views showing a fourth embodiment of the present invention.
Figure 5B:
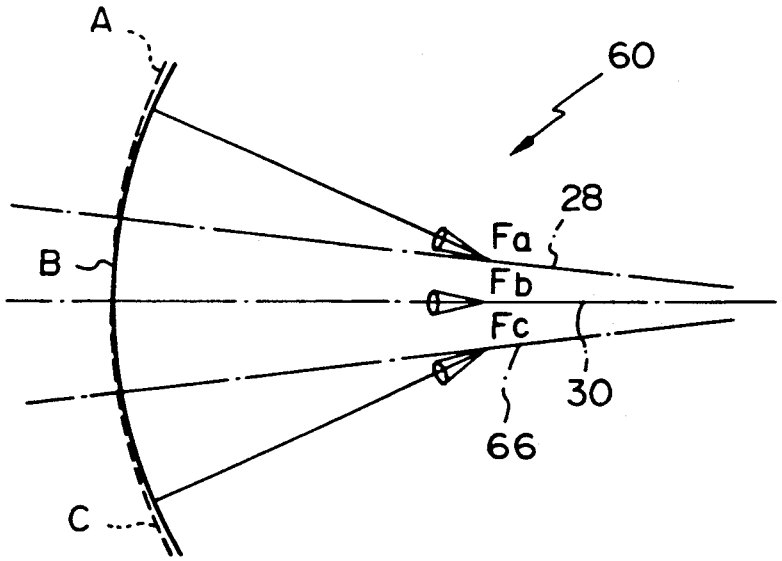

Referring to FIGS. 5A and 5B, a fourth embodiment of the multibeam antenna in accordance with the present invention is shown. In the figures, a multibeam antenna 60 is constructed to function as a three-beam antenna. As shown, the main reflector 22 includes three partial reflectors 22A, 22B and 22C. The partial reflectors 22A and 22B join each other along the boundary line 32, and the partial relectors 22B and 22C join each other along a boundary line 62. The reflectors 22A, 22B and 22C are constituted by, respectively, a part of the paraboloid A, a part of the paraboloid B, and a part of a parabolic plane C. The parabolic planes A, B and C have, respectively, foci Fa, Fb and Fc which are different from each other and axes of rotation 28, 30 and 64 which are different in direction from each other. The primary radiators 24 and 26 and a primary radiator 66 are located at, respectively, the foci Fa, Fb and Fc of the axes 28, 30 and 64. The principle of operation of the antenna 60 is the same as that of the first embodiment and, therefore, will not be described to avoid redundancy.

The overlapping portion **22*c* of the radiation regions on the main reflector in any of the first to fourth embodiments will be described in more detail. As previously stated, the regions 22*a* and 22*b*** can be aligned with the paraboloids A and B, respectively, by adequately selecting the distance *2d* between, for example, the primary radiators 24 and 26 of FIGS. 3A and 3B. However, the alignment is only approximate and not precise. Specifically, that part of the region **22*b* which lies in the ovelapping portion 22*c* has a surface curve which is defined by the paraboloid B, and that part of the region 22*a* which lies in the overlapping portion 22*c* has a surface curve which is defined by the paraboloid A. In this condition, since the focus Fa is not coincident with the focus of the partial reflector 22B (paraboloid B), that part of rays radiating from the focus Fa which are incident to the partial reflector 22B in the overlapping portion 22*c* become substantially and not precisely parallel to the center axis 28 after being reflected by the reflector 22B. It follows that the optical path which interconnects the focus Fa, the reflector 22B and a plane which is perpendicular to the axis 28** in this order is not constant in length and has some error, i.e., phase error.

No doubt, such a phase error does not affect the usefulness of the first to fourth embodiments at all because the phase error is not noticeable, because the curve of the major part of the region **22*b* is defined by the paraboloid A, and because the curve of the region 22*a* is defined by the paraboloid B. Specifically, for such reasons, the decrease in the phase efficiency in the aperture plane which is ascribable to the phase error is lower than that ascribable to a phase error which would be caused if any of the primary radiators of the prior art multibeam antenna shown in FIG. 1** were deviated from the focus.

In order to allow a minimum of decrease to occur in the phase efficiency in the aperture plane, it is a prerequisite that the regions **22*b* and 22*a* mainly use the partial reflectors 22A and 22B, respectively, i.e., the overlapping portion 22*c* be reduced. This, however, brings about another drawback that the lateral dimension of the main reflector 22** is increased.

Figure 6:
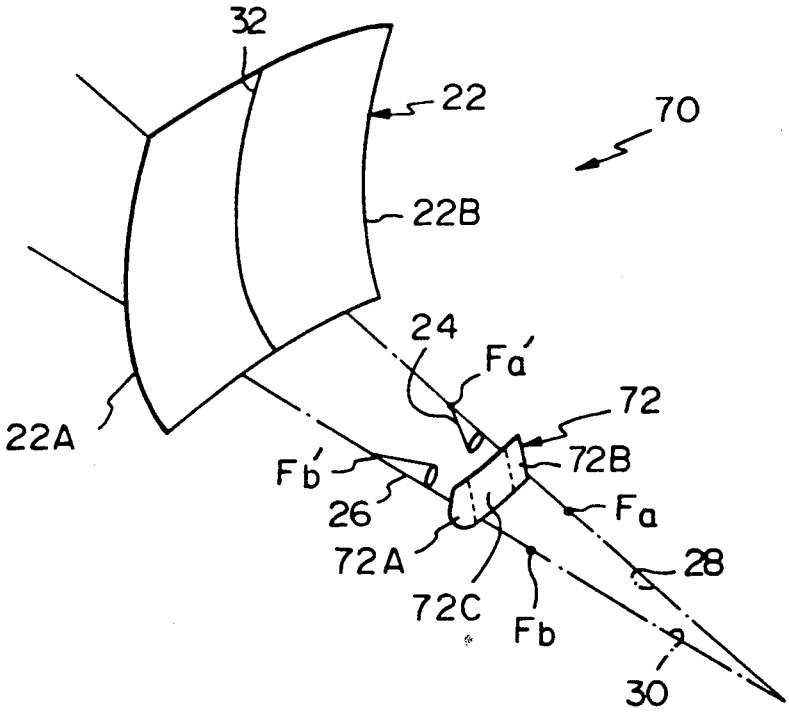
FIG. 6 is a view showing a fifth embodiment of the present invention.

Referring to FIG. 6, a fifth embodiment of the present invention is shown which solves the above dilemmatic situation. As shown, a multibeam antenna 70 of FIG. 6 includes the main reflector 22, two primary radiators 24 and 26, and a single subreflector 72. The main reflector 22 is constituted by the partial reflectors 22A and 22B which constitute, respectively, a part of the paraboloid A and a part of the paraboloid B. The partial reflectors 22A and 22B are joined to each other along the boundary line 32 such that their center axes 28 and 30 intersect each other. The subreflector 72 is located between the focus Fa of the paraboloid A which is positioned on the axis 28 and the focus Fb of the paraboloid B which is located on the axis 30.

Figure 7:
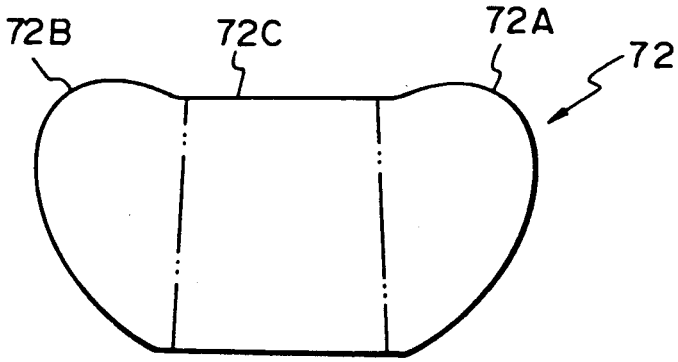
FIG. 7 is an external view of a subreflector of the multibeam antenna as shown in FIG. 6.

As shown in FIG. 7, the subreflector 72 is made up of three portions, i.e., a curved portion 72A close to the partial reflector 22A, a curved portion 72B close to the partial reflector 22B, and a flat intermediate portion 72C which interconnect the two curved portions 72A and 72B. The surface curves of the curved portions 72A and B are individually determined as will be described later.

The primary reflectors 24 and 26 are located at, respectively, inverted image points F'a and F'b which are symmetrical to the foci Fa and Fb with respect to the subreflector 72, each radiating an electromagnetic wave toward the subreflector 72.

Figure 8:
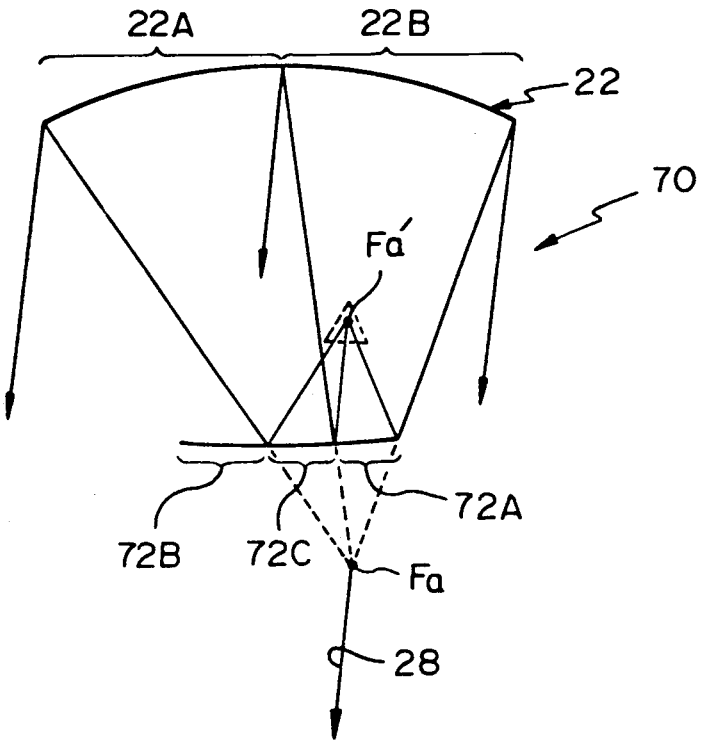
FIGS. 8 and 9 are schematic diagrams showing how the curved configuration of the subreflector shown in FIG. 6 is designed.

How the curves of the subreflector 72 are determined will be explained with reference to FIGS. 8 an 9. In FIG. 8, assuming that the subreflector 72 is absent, those of the numerous rays radiating from the focus Fa which are incident to the partial reflector (paraboloid A) 22A are reflected by the paraboloid A without exception to become rays which are parallel to the center axis 28; the distances measured from the focus Fa to a plane which is perpendicular to the axis 28 by way of the paraboloid A are equal to each other. It follows that if that portion of subreflector 72 which is associated with the paraboloid A, i.e., the intermediate portion 72c is flat, those of the rays radiating from the point F'a which are incident to the intermediate portion 72C are reflected by the portion 72C and, then, by the paraboloid A to be thereby turned into rays which are parallel to the axis 28.

On the other hand, when the subreflector 72 is absent, among rays radiating from the focus Fa, those which are incident to the partial reflector (paraboloid B) 22B are reflected by the paraboloid B to become generally parallel to the axis 28. However, the distances measured from the focus Fa to the plane which is parallel to the axis 28 by way of the paraboloid B are not the same as each other and involve some error. In light of this, that part (curved portion 72A) of the subreflector 72 which is associated with the paraboloid is provided with a predetermined curve which is slightly deviated from a plane. In this condition, the lengths of the optical paths along which rays are radiated from F'a, then reflected by the curved portion 72A, and then incident to the plane which is perpendicular to the axis 28 become equal to each other. This reduces the decrease in efficiency due to phase errors which are ascribable to the paraboloid B.

Figure 9:
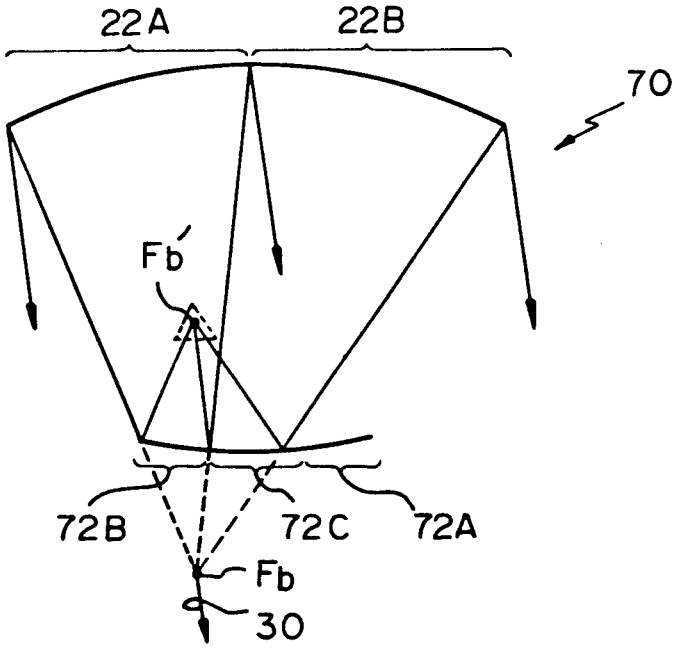

FIG. 9 is a view similar to FIG. 8, showing rays which are radiating from the other point F'b toward the axis 30. Details of FIG. 9 will be understood by analogy from FIG. 8.

The gist is that the surface curves of the curved portions 72A and 72B of the subreflector 72 are so selected as to compensate for or reduce the phase error in the event when electromagnetic waves reflected by the curved portions are radiated by their associated partial reflectors.

It will be seen from the above that the size of the curved portion 72A and that of the curved portion 72B are dependent upon the sizes and focuses of their associated partial reflectors and the location of the subreflector 72. While the intermediate portion 72c is shown as being sized substantially the same size as the curved portions 72A and 72B, its size is variable depending upon, for example, the difference in focal length between the two paraboloids. By comparing FIGS. 8 and 9, it will be understood that that area of the subreflector 72 to which the rays radiating from the point F'a and those radiating from the point F'b are incident is included in the intermediate portion 72C. This, coupled with the fact that the intermediate portion 72C is flat, allows the intermediate portion 72C to be shared by those two different groups of rays without entrailing any phase error. In this manner, the subreflector 24 is capable of simultaneously compensating for phase errors which occur on the main reflector 22 with respect to the two different directions of radiations. Consequently, since that part of an electromagnetic wave radiating from the primary radiator 24 which is incident to the partial reflector 22B is compensated for in phase error, the limitation that, for example, the wave from the radiator 24 should mainly use the partial reflector 22A is eliminated. Hence, as shown in FIGS. 8 and 9, the same region of the main reflector 22 can be shared by two different beams, promoting the decrease in the lateral dimension of the main reflector 22.

While the present invention has been shown and described in relation to a two-beam and a three-beam antenna, it will be apparent that it is similarly applicable to an antenna of the type using four or more beams.

Further, although the foregoing description has concentrated on a situation wherein a plurality of focuses and the axes of rotation of a plurality of paraboloids are positioned in the same plane, such is only illustrative and may be replaced with a situation wherein, for example, the axes 28 and 30 of the paraboloids A and B, respectively, are in a distorted relationship. Specifically, the axes 28 and 30 may each be extended in any desired direction other than the same plane.

It is not necessary that angles between the individual axes of rotation and the associated primary reflectors be equal to each other.

In addition, the focal lengths of the paraboloids may not be equal to each other, and the contour of the main reflector is open to choice.

In summary, it will be seen that the present invention provides a highly efficient multibeam antenna despite that nearby ones of a plurality of radiation regions which are defined on a single main reflector overlap each other. This is because the curve of each radiation region is provided with substantially the same paraboloid as the surface curve of a radiation region which is defined on a single main reflector and, hence, each of the radiation regions can be regarded as a parabolic reflector which is independent of the others. Another advantage attainable with the present invention is that the length of antenna axis can be reduced by transmitting electromagnetic radiations from a plurality of primary radiators indirectly to a main reflector by way of a single flat reflector.

Further, in accordance with the present invention, a subreflector capable of compensating for phase errors particular to the radiation of electromagnetic waves by a main reflector is interposed between the main reflector and primary radiators, whereby the decrease in the phase efficiency in the aperture plane is suppressed. Since phase errors are compensated for by the subreflector as stated, it is not necessary to accurately match the primary reflectors with partial reflectors which constitute the main reflector and, therefore, the lateral dimension of the main reflector can be reduced.

Various modifications will become possible for those skilled in the art after receiving the teachings of the present disclosure without departing from the scope thereof.

What is claimed is:

1. A multibeam antenna comprising:

a main reflector constituted by at least a first and a second partial reflector, each having a uniform paraboloid surface, said first partial reflector being defined by a part of a first paraboloid which has a first focus and a first axis of rotation, said second partial reflector being defined by a part of a second paraboloid which has a second focus and a second axis of rotation, said first and second partial reflectors being positioned such that they form a single curved surface with said first and second axis oriented in different directions relative to each other, said first and second said paraboloids being interconnected by a connecting portion having the shape of an unclosed curve within the main reflector;

a subreflector located between said main reflector and said first and second focuses comprising: a first curved portion located on the same side as said first partial reflector which is located on one side with respect to a center axis of said antenna, a second curved portion located on the same side as said second partial reflector which is located on the other side with respect to said center axis, and an intermediate portion interconnecting said first and second curved portions;

a first primary radiator radiating an electromagnetic wave toward said main reflector to irradiate said first partial reflector and a part of said second reflector; and a second primary radiator for radiating an electromagnetic wave toward said main reflector to illuminate said second partial reflector and a part of said first partial reflector, wherein said first and second primary radiators are located at, respectively, a first and a second inverted image point which are symmetrical to, respectively, said first and second focuses with respect to said subreflector, said first and second primary radiator each radiating an electromagnetic wave indirectly toward said main reflector through said subreflector.

2. A multibeam antenna as claimed in claim 1, wherein said first and second focuses are different in position from each other.

3. A multibeam antenna as claimed in claim 1, wherein said first primary radiator and said first partial reflector are located on one side with respect to a center axis of said antenna, and said second primary radiator and said second partial reflector are located on the other side with respect to said center axis.

4. A multibeam antenna as claimed in claim 1, wherein said first primary radiator and said second partial reflector are located on one side with respect to a center axis of said antenna, and said second primary radiator and said first partial reflector are located on the other side with respect to said center axis.

5. A multibeam antenna as claimed in claim 1, wherein said intermediate portion has a flat surface.

6. A multibeam antenna as claimed in claim 5, wherein the surface curve of the first curved portion is so selected as to compensate for the phase error of an electromagnetic wave which is radiated from the first partial reflector, while the surface curve of the second curved portion is so selected as to compensate for the phase error of an electromagnetic wave which is radiated from the second partial reflector.

* * * * *